United States Patent [19]

Ikeda

[11] 4,286,344

[45] Sep. 1, 1981

[54] MATTRESS

[75] Inventor: Minoru Ikeda, Kokubunji, Japan

[73] Assignee: France Bed Co., Ltd., Tokyo, Japan

[21] Appl. No.: 105,929

[22] Filed: Dec. 21, 1979

[30] Foreign Application Priority Data

| | | | |
|---|---|---|---|
| Oct. 22, 1979 | [JP] | Japan | 54-136266 |
| Nov. 6, 1979 | [JP] | Japan | 54-154004[U] |
| Nov. 6, 1979 | [JP] | Japan | 54-154005[U] |
| Nov. 6, 1979 | [JP] | Japan | 54-154006[U] |

[51] Int. Cl.[3] ..... A47C 23/04

[52] U.S. Cl. ..... 5/424; 5/474; 5/475; 5/420

[58] Field of Search ..... 5/94, 100, 400, 420, 5/424, 425, 427, 437, 474, 475, 481

[56] References Cited

U.S. PATENT DOCUMENTS

| | | | |
|---|---|---|---|
| 1,432,875 | 10/1922 | Lavagetlo | 5/424 |
| 2,627,902 | 2/1953 | Cook | 5/474 |
| 2,717,636 | 9/1955 | Hormuth | 5/474 |
| 3,681,798 | 8/1972 | Docker | 5/475 |
| 3,848,283 | 11/1974 | Ikeda | 5/474 |
| 4,096,596 | 6/1978 | Pearson | 5/474 |
| 4,109,887 | 8/1978 | Wakeland | 5/400 |

*Primary Examiner*—Casmir A. Nunberg

*Attorney, Agent, or Firm*—Frishauf, Holtz, Goodman & Woodward

[57] ABSTRACT

A mattress includes a pair of ridges made of elastomeric material and disposed respectively on both sides of an elastomeric layer which is laid on the top of a spring unit and covered with an outer covering, the ridges protruding from the elastomeric layer. Each ridge partially or fully extends in the longitudinal direction of the elastomeric layer. A user lying on the mattress is prevented from falling from the mattress by the ridges.

10 Claims, 16 Drawing Figures

MATTRESS

BACKGROUND OF THE INVENTION

This invention relates to a mattress to be set on a bed frame.

A mattress is usually put on the bed frame and thus placed above the floor. Since the top of the mattress is flat and smooth, a user sleeping on it may fall onto the floor and may be injured. A known mattress has no means for preventing the user from falling. The user cannot help but be careful not to fall from the mattress. He must lie on the central part of the mattress, thus leaving the outer margins of the mattress unoccupied almost all the time he is sleeping.

SUMMARY OF THE INVENTION

It is therefore an object of this invention to provide a mattress with fall preventing means.

To this end, a mattress according to a preferred embodiment of this invention comprises fall preventing means disposed at least on top side an of elastomeric layer, extending in the longitudinal direction thereof and protruding from the elastomeric layer, whereby a user on the mattress will be prevented from falling from the mattress.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

Figure 1:
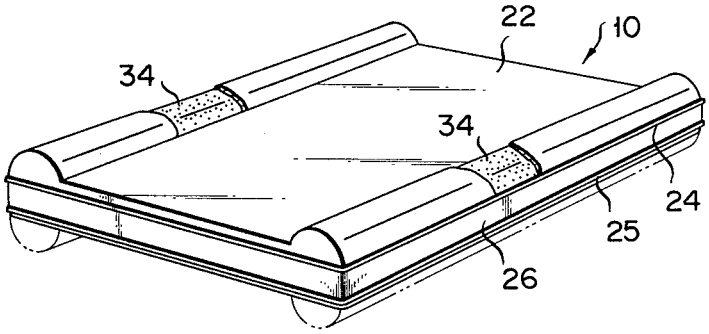
FIG. 1 is a schematic perspective view of a mattress according to a preferred embodiment of this invention.
Figure 2:
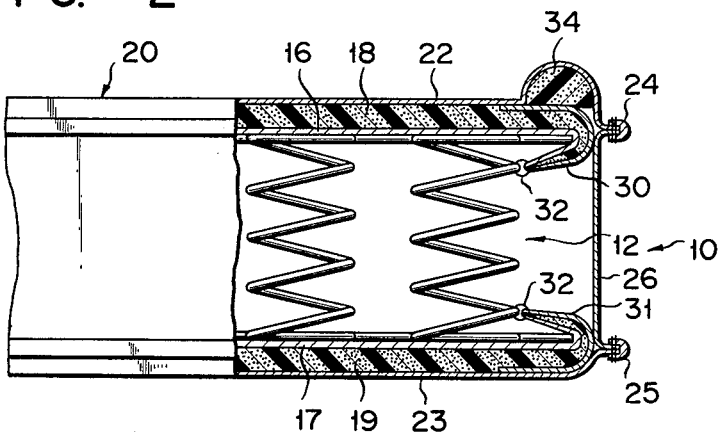
FIG. 2 is a partially cross-sectional view of the mattress of FIG. 1.
Figure 3:
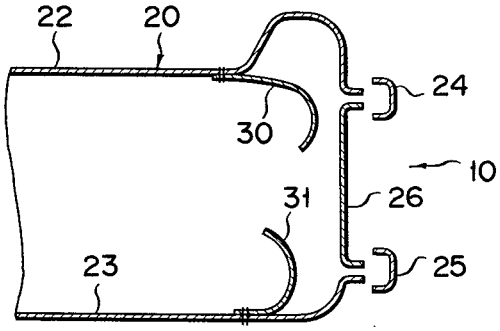
FIG. 3 is a partially cross-sectional view of an outer covering of the mattress of FIG. 1.

As shown in FIGS. 1 to 3, a mattress 10 according to this invention comprises a spring unit 12 including a plurality of coil springs 14 which are arranged parallel to one another. Elastomeric layers 18 and 19 made of, for example, urethane foam are disposed on the top and bottom of the spring unit 12, respectively. Under the elastomeric layers a pair of pads 16 and 17 made of sisal material or the like are laid on the top and bottom of the spring unit 12, respectively. Over the pad 16 the elastomeric layer 18 is disposed, and over the pad 17 the elastomeric layer 19 is disposed. If unnecessary, the layer 19 may not be laid on the pad 17. The elastomeric layers 18 and 19 are covered with a common outer covering 20. The outer covering 20 is formed of an upper cover 22 wrapping the upper elastomeric layer 18, a lower cover 23 wrapping the lower elastomeric layer 19, and a gusset 26 the upper and lower edges of which are sewed to the peripheries of the upper and lower covers 22 and 23 by means of cloth tapes 24 and 25, respectively. Respective one ends of a pair of connecting strips 30 and 31 are severally sewed to both sides of the upper and lower covers 22 and 23 across the widths thereof, covering the full lengths of the covers 22 and 23. The other ends of the connecting strips 30 and 31 are severally connected with the coil springs 14 along the periphery of the spring unit 12 by means of snap rings 32, involving therein the peripheries of the elastomeric layer 18 or 19 and pad 16 or 17. Further, a pair of ridges 34 fixed on the connecting strips 30 by, for example, an adhesive are interposed between the upper cover 22 and the connecting strip 30. A pair of ridges 34 are disposed respectively on both sides of the elastomeric layer 18 and extending fully in the longitudinal direction thereof, protruding from the elastomeric layer 18. The ridge 34 is made of elastomeric material such as urethane foam, and has a sectional shape including a partial circle. With a varied foaming rate, the ridge 34 is harder than the elastomeric layer 18. In order to wrap the ridge 34 together with the elastomeric layer 18, the upper cover 22 has a greater width than that of the lower cover 23.

Thus, according to this invention, the mattress 10 comprises the ridges 34 disposed respectively on both sides of the elastomeric layer 18 and extending in the longitudinal direction of the elastomeric layer 18. The ridges 34 protrude from the elastomeric layer 18 so as to prevent a user lying on the mattress 10 from falling onto the floor. The user therefore need not be careful to lay himself on the central part of the mattress; he can lie on the outer margin of the mattress without fearing of falling onto floor. Laid on the connecting strip 30, moreover, the ridges 34 can be prevented from being shifted from their predetermined positions. Since the ridges 34 have a sectional shape including a partial circle and are harder than the elastomeric layer 18, as mentioned above, they are agreeable to the touch and can provide necessary resistivity. As indicated by two dot-dash lines in FIG. 1, the ridges 34 may be also disposed on the elastomeric layer 19 as well as on the elastomeric layer 18.

Figure 4:
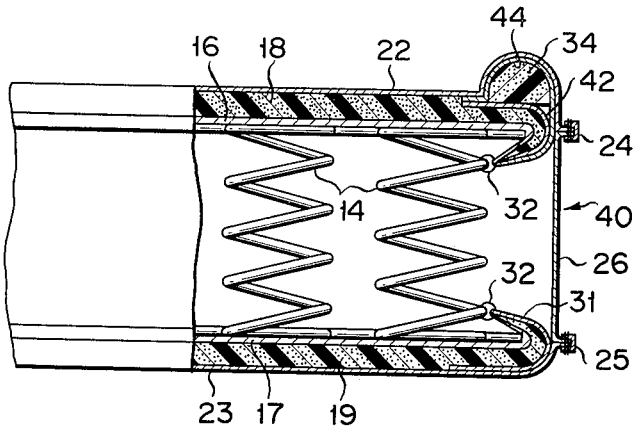
FIG. 4 is a partially cross-sectional view of a mattress according to another preferred embodiment of the invention.
Figure 5:
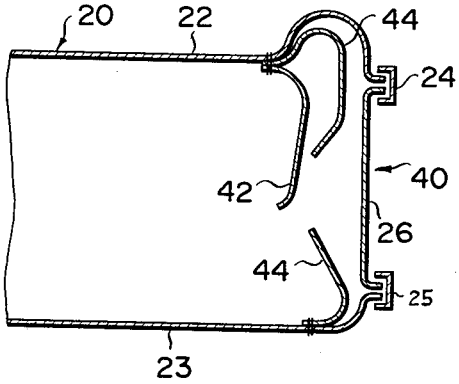
FIG. 5 is a partially cross-sectional view of an outer covering of the mattress of FIG. 4.

FIGS. 4 and 5 show a mattress 40 according to another embodiment of this invention. The mattress 40 has the same construction of the mattress 10 except that each ridge 34 is fixed on a first connecting strip 42 and that a second connecting strip 44 covers the upper surface of the ridge 34 so that the ridge 34 is held between the first and second connecting strips 42 and 44. The other members of the mattress 40 are denoted by like or the same numerals as the similar members of the embodiment shown in FIGS. 1 to 3. Other embodiments are shown in FIGS. 6 to 16, wherein like or the same numerals are used to denote like or the same members as in FIGS. 1 to 3. Like the connecting strip 30 of the mattress 10, the first and second connecting strips 42 and 44 have their respective two ends connected to an upper cover 22 and coil springs 14, respectively.

In the mattress 40, each ridge 34 is not only fixed on the first connecting strip 42 but also held between the first and second connecting strips 42 and 44, so that it is securely kept in a predetermined position on an elastomeric layer 18. Thus, the ridge 34 can more securely be prevented from shifting its position as compared with the one used with the mattress 10. If necessary, the ridge 34 may be secured to the second connecting strip 44 by an adhesive.

Figure 6:
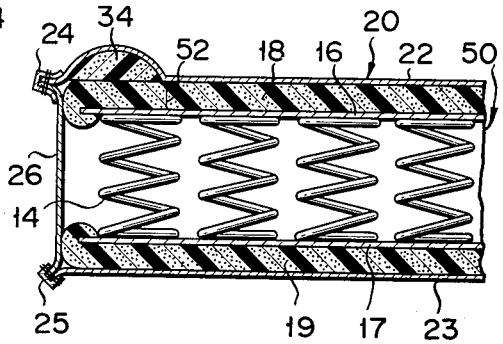
FIGS. 6 to 8 are partially cross-sectional views of mattresses according to alternative preferred embodiments of the invention.
Figure 7:
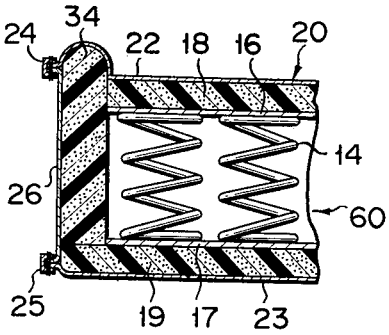
Figure 8:
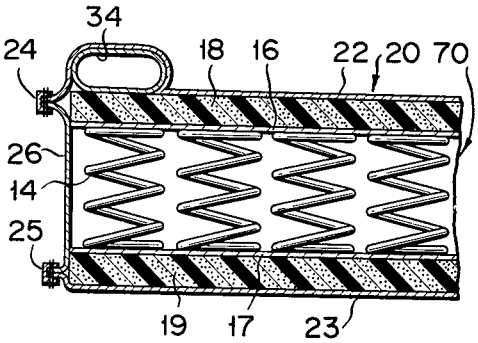

FIGS. 6, 7 and 8 show mattresses 50, 60 and 70 according to further embodiments of this invention, respectively. Unlike the mattresses 10 and 40, the mattress 50 of FIG. 6 utilizes none of the connecting strips 30, 31, 42 and 44, and is so constructed that an upper cover 22 is connected to an elastomeric layer 18 by means of a thread 52 at the lateral portion of a ridge 34. Despite the simple construction, therefore, the upper cover 22 is prevented from being removed from the elastomeric layer 18, so that the ridge 34 is securely held in a predetermined position between the elastomeric layer 18 and the upper cover 22, and thus is prevented from moving. The mattress 60 of FIG. 7 comprises a pair of ridges 34 each of which is disposed in parallel with coil springs 14 on each side of an elastomeric layer 18, extending in the longitudinal direction of the elastomeric layer 18 and having a rectangular section with a partial circle at the top end thereof. In the mattress 60, each ridge 34 is not interposed between an upper cover 22 and the elastomeric layer 18, and is located on the inside of an elastomeric layer 19 to be in contact with a gusset 26, so that it can perfectly be prevented from moving. Since the mattress 60 is made more rigid at both outer margins than at the central part, the ridge 34 may more effectively prevent a user from falling from the mattress 60.

The mattress 70 shown in FIG. 8 comprises a pair of ridges 34 and an upper cover 22, like the above-described embodiments. Each ridge 34 is a long flexible tube, and the upper cover 22 is made of soft and flexible cloth. When air is pumped into the ridge 34 through an air inlet/outlet port (not shown), the ridge 34 is inflated to such extent that it prevents a user from falling from the mattress 70. When no means for preventing a user from falling is necessary, the ridge 34 is deflated by discharging air from it and the upper cover 22 contracts, whereby the top of the mattress 70 becomes substantially flat. With such construction, the ridge 34 can suitably be utilized as required.

Figure 9:
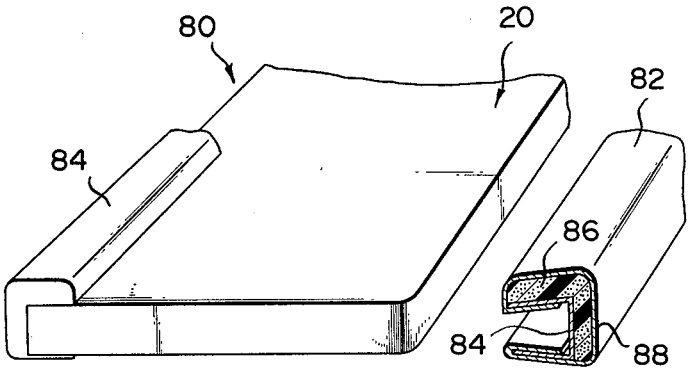
FIGS. 9 and 11 are partially broken perspective views of mattresses according to further preferred embodiments of the invention.
Figure 10:
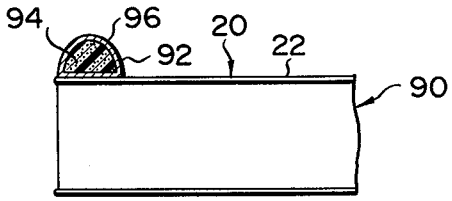
FIG. 10 is a partially broken front view of a mattress according to another preferred embodiment of the invention.

FIGS. 9 and 10 show mattresses 80 and 90 comprising removable ridges 82. Each ridge 82 of the mattress 80 of FIG. 9 includes a holding plate 84 having a channel-shaped section and removably holding the mattress 80, an elastomeric core 86 disposed on the bottom side and one lateral side of the holding plate 84 and formed of elastomeric material such as urethane foam, and an outer covering 88 to cover the elastomeric core 86. The width of the open end of the holding plate 84 is narrower than the thickness of the mattress 80 so that the holding plate 84 may be elastically attached to each side portion of the mattress, and thus the user of the mattress 80 is protected against a fall by the elastomeric core 86 located in the upper position of the holding plate 84. The ridge 82 of such construction can be attached to and removed from the mattress 80 as required; when cleared away the ridge 82, the mattress 80 may be used as a conventional mattress without any fall preventing means.

The mattress 90 shown in FIG. 10 differs from the above-described embodiments in that a pair of ridges 92 are fixed to an upper cover 22 by an adhesive or any other means. Each ridge 92 is constituted by an elastomeric core 94 made of, for example, urethane foam and a covering 96 wrapping the elastomeric core 94. Preferably, a velvet fastener is used to secure the ridges 92 to the upper cover 22, so that the ridges 92 may be removed from the cover 22 when unnecessary.

Figure 11:
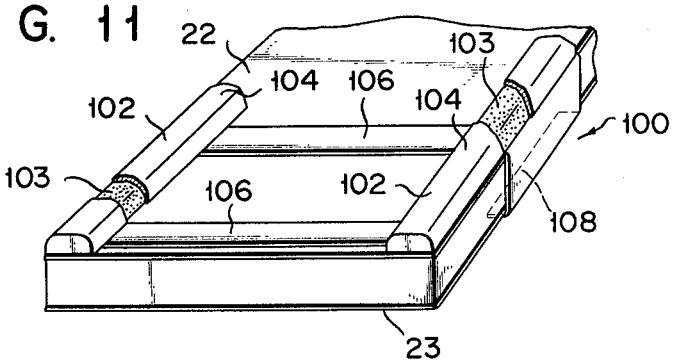

FIG. 11 shows a mattress 100 according to still another embodiment of the invention. In the mattress 100, a pair of ridges 102 each include an elastomeric core 103 made of elastomeric material and a covering 104 wrapping the elastomeric core 103. The ridges 102 are connected on their respective facing sides at a space substantially equal to the width of the mattress 100 by means of belt- or string-shaped connecting members 106, for example, two in number. A plurality of tuck cloths 108 are sewed on the other side of each ridge 102. In the mattress 100 of such construction, the ridges 102 are disposed on both sides of an upper cover 22, respectively, the tuck cloths 108 are tucked onto a lower cover 23, and the end portions of the tuck cloths 108 are stuck or sewed or fixed by a velvet fastener to the lower cover 23.

Figure 12:
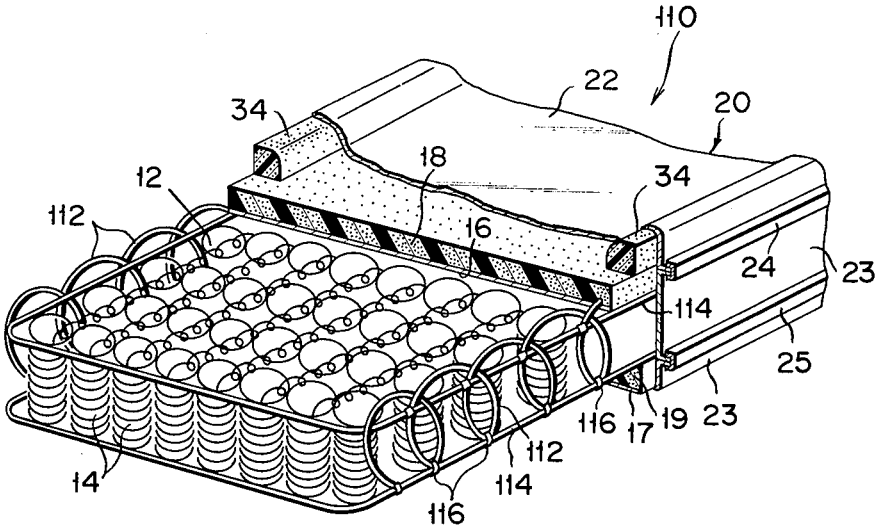
FIG. 12 is a partially broken perspective view of a mattress according to still another embodiment of the invention, part of which is omitted.
Figure 13:
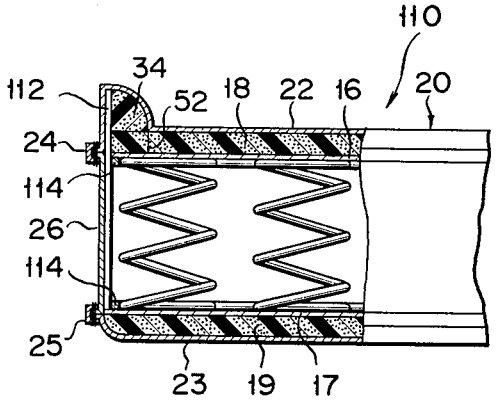
FIG. 13 is a partially broken cross-sectional view of the mattress of FIG. 12.
Figure 14:
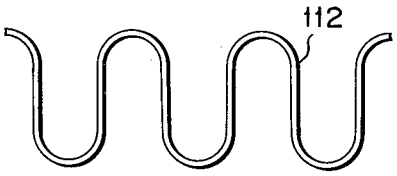
FIGS. 14 and 15 are side views showing modified examples of a reinforcement spring used with the mattress of FIG. 12.

In a mattress 110 as shown in FIGS. 12 and 13, moreover, a plurality of reinforcement springs 112 formed of flatly coiled wires and having a height greater than that of a spring unit 12 are fixed to a pair of wire-like frames 114 on both sides of the spring unit 12 by means of clips 116 so that the springs 112 project beyond the top of the spring unit 12. Portions of the reinforcement springs 112 projected above the top side of the spring unit 12 are in contact with the lateral sides of ridges 34. In order to prevent an upper cover 22 from being lifted off an elastomeric layer 18, the upper cover 22 is connected to the elastomeric layer 18 by means of a thread 52 at a side portion of each ridge 34. Thus, in the mattress 110, the spring unit 12 is provided with the reinforcement springs 112 that are fixed to the frames 114 so as to be in contact with the respective lateral sides of the ridges 34 on both sides across the width of the spring unit 12. Accordingly, the ridges 34 may be prevented from being moved on the elastomeric layer 18 by the reinforcement springs 112 to fall from the elastomeric layer. Further, both side portions of the spring unit 12 are improved in rigidity due to the reinforcement springs 112 fixed thereto, so that the available area of the mattress 110 may be increased.

Figure 15:
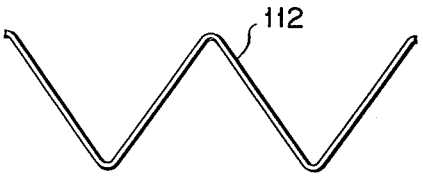

The reinforcement springs 112 are not limited to the coiled wires, and may be any continuously curved wires, substantially U-shaped (FIG. 14) or V-shaped (FIG. 15). The point is that they should be flat in shape and have spring effect in the vertical direction.

Figure 16:
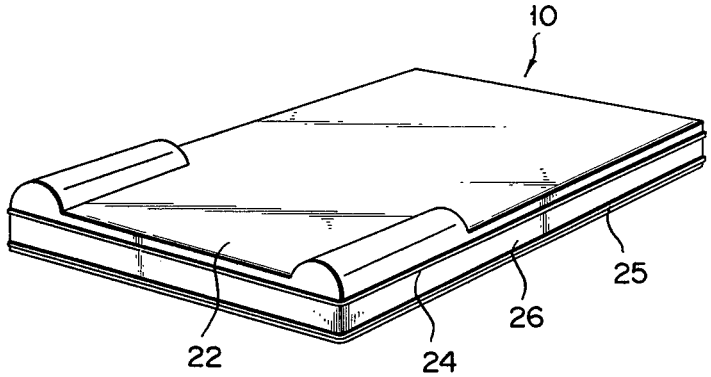
FIG. 16 is a schematic perspective view of a mattress, in which a pair of ridges are extending partially in the longitudinal direction of the elastomeric layer.

In the mattresses according to above-mentioned embodiments, the ridges are disposed on both sides to extend in the longitudinal direction of the elastomeric layer. Alternatively, however, the ridge may be disposed on one side or head side to extend across the width of the elastomeric layer, thereby preventing a pillow from slipping down the mattress, or on the other side or foot side. It is to be understood that the invention may be also applied to a so-called bottom mattress in which an elastomeric layer is disposed only on the top side of a spring unit. As shown in FIG. 16, the ridges may be extended partially in the longitudinal direction of the mattress.

As described above, the mattress of the invention comprises ridges which are formed of elastomeric material and disposed at least on top side of elastomeric layer to bear a user, so that the user may be prevented from falling from the mattress by the ridges even if he turns over in sleep. Furthermore, the prevention of fall owing to the ridges will lead to an increase in the available area of the mattress, enabling effective use of the marginal region of the mattress.

What is claimed is:

1. A mattress for preventing a user lying thereon from falling from the mattress, comprising:

a spring unit (12) including a plurality of coil springs arranged in parallel with one another;

an elastomeric layer (18;19) disposed at least on one of the top and bottom of the spring unit (12) and wrapped with an outer covering (20; 22,23), whereon a user is to lie;

fall preventing means disposed at least on the top side of the elastomeric layer, said fall preventing means including a pair of ridges (34) of elastomeric material extending in the longitudinal direction of the elastomeric layer and protruding from the elastomeric layer, each ridge (34) of said fall preventing means having a sectional shape including a partial circle and being harder than the elastomeric layer, and each ridge of said fall preventing means being interposed between the outer covering (20; 22,23) and the elastomeric layer (18;19); and connecting means (30,31; 42) one end of which is connected to the outer covering (20;22, 23) and the other end of which is connected to the coil springs of the spring unit (12), each ridge (34) being fixed to said connecting means intermediate the connection to the outer covering and the connection to the coil springs;

whereby the user lying on the elastomeric layer on which said fall preventing means is disposed will be prevented from falling from the mattress.

2. A mattress according to claim 1, wherein said connecting means includes a first connecting strip the top of which is fixed by the ridge and a second connecting strip covering the top of the ridge and holding the ridge in conjunction with the first connecting strip.

3. A mattress according to claim 2 wherein said second connecting strip covering the top of the ridge urges the ridge toward the respective elastomeric layer.

4. A mattress according to claim 1, wherein each ridge of said fall preventing means is formed of a long flexible tube.

5. A mattress according to claim 1, wherein each ridge of said fall preventing means is wrapped with a covering and is attached to the outer covering.

6. A mattress according to claim 5, wherein the ridges of the fall preventing means are connected with each other by connecting means, and each include a plurality of tuck cloths each attached to the bottom of the mattress and extending from one side of each ridge so as to cover each side of the mattress.

7. A mattress according to any one of claims 1, or 4, comprising a reinforcement spring adjacent a frame of said spring unit, and wherein each ridge of said fall preventing means is prevented from moving sideways by said reinforcement spring, said reinforcement spring extending beside the ridge so as to come in contact with one side of the ridge and having a spring effect to act across the thickness of the mattress.

8. A mattress according to claim 1, wherein said connecting means is connected to the outer covering adjacent its associated ridge (34).

9. A mattress according to claim 8, wherein each ridge has a base, and wherein said connecting means is connected to said outer covering adjacent the associated base of a ridge.

10. A mattress according to claim 1 or 8, wherein said connecting means is sewed to the outer covering to connect same to the outer covering.

* * * * *